US009409210B2

(12) United States Patent
Berkhout et al.

(10) Patent No.: US 9,409,210 B2
(45) **Date of Patent: *Aug. 9, 2016**

(54) SEPARATION-APPARATUS

(75) Inventors: Simon Peter Maria Berkhout, Delft (NL); Peter Carlo Rem, Rijswijk (NL)

(73) Assignee: ADR TECHNOLOGY B.V., Rotterdam (NL)

( * ) Notice: Subject to any disclaimer, the term of this patent is extended or adjusted under 35 U.S.C. 154(b) by 607 days.

This patent is subject to a terminal disclaimer.

(21) Appl. No.: 12/936,058

(22) PCT Filed: Apr. 1, 2009

(86) PCT No.: PCT/NL2009/050165

§ 371 (c)(1),
(2), (4) Date: Dec. 10, 2010

(87) PCT Pub. No.: WO2009/123452

PCT Pub. Date: Oct. 8, 2009

(65) Prior Publication Data

US 2011/0084005 A1 Apr. 14, 2011

(30) Foreign Application Priority Data

Apr. 2, 2008 (NL) ..... 2001431

(51) Int. Cl.
*B07C 5/00* (2006.01)
*B07B 13/10* (2006.01)

(52) U.S. Cl.
CPC ..... *B07B 13/10* (2013.01)

(58) Field of Classification Search
CPC ..... B07B 13/00; B07B 13/10; B07B 13/003; B22C 5/06
USPC ..... 209/637, 638, 640, 642, 44.2, 639, 644
See application file for complete search history.

(56) References Cited

U.S. PATENT DOCUMENTS 2,095,385 A * 10/1937 Heisserman ..... B22C 5/02 209/145
2,662,641 A 12/1953 Clark (Continued)

FOREIGN PATENT DOCUMENTS

CN 1895796 A 1/2007
CN 201482560 U 5/2010

(Continued)

OTHER PUBLICATIONS

International Preliminary Report on Patentability dated Aug. 23, 2010 from PCT/NL2009/050165.

(Continued)

*Primary Examiner* — Joseph C Rodriguez
*Assistant Examiner* — Kalyanavenkateshware Kumar
(74) *Attorney, Agent, or Firm* — Swanson & Bratschun, L.L.C.

(57) ABSTRACT

The invention relates to a separation-apparatus for separating from a particle-stream at least a first fraction with particles of a first group of dimensions, and a second fraction with particles of a second group of dimensions, comprising an infeed-device for the particle-stream, a rotatable drum having at its circumference plates, each plate having a radially extending hitting surface for the particles, at least a first receiving area proximal to the drum for receipt therein of particles of the first fraction, and at least a second receiving area distant from the drum for receipt therein of particles of the second fraction, wherein the apparatus has a housing so as to protect the particles from outside weather-conditions, allowing that the particles of the particle-stream to be processed by said apparatus have dimensions in the range 0-15 mm.

14 Claims, 3 Drawing Sheets

(56) References Cited

U.S. PATENT DOCUMENTS

| | | | | |
|---|---|---|---|---|
| 2,772,776 | A | 12/1956 | Myron | |
| 3,356,213 | A | 12/1967 | Weber | |
| 3,430,870 | A | 3/1969 | Weston | |
| 3,757,946 | A | 9/1973 | Berkowitz | |
| 4,185,746 | A | 1/1980 | Fegan, Jr. | |
| 4,267,930 | A | 5/1981 | Melkonian | |
| 4,944,868 | A | 7/1990 | Jay | |
| 5,301,816 | A | 4/1994 | Weber | |
| 5,394,991 | A | 3/1995 | Kumagai | |
| 5,860,532 | A | 1/1999 | Arvidson | |
| 5,998,212 | A | 12/1999 | Corio | |
| 6,068,133 | A | 5/2000 | Schonfeld | |
| 6,095,337 | A | 8/2000 | Saveliev | |
| 6,351,676 | B1 | 2/2002 | Thomas | |
| 6,541,725 | B2 * | 4/2003 | Pearson | 209/590 |
| 6,589,654 | B1 | 7/2003 | Arcaini | |
| 7,367,457 | B2 | 5/2008 | Warlitz | |
| 7,726,493 | B2 | 6/2010 | Van Der Weijden | |
| 8,392,135 | B2 | 3/2013 | McClain | |
| 8,459,466 | B2 | 6/2013 | Duffy | |
| 8,678,194 | B2 | 3/2014 | Rem | |
| 8,705,031 | B2 | 4/2014 | Sedoglavich | |
| 8,807,344 | B2 | 8/2014 | Keaton | |
| 8,919,566 | B2 | 12/2014 | Golovanevskiy | |
| 8,931,644 | B2 | 1/2015 | Lean | |
| 9,016,478 | B2 | 4/2015 | Bohnlein | |
| 9,033,157 | B2 * | 5/2015 | Berkhout | B07B 13/10 209/644 |
| 2003/0000835 | A1 | 1/2003 | Witt | |
| 2004/0040894 | A1 | 3/2004 | Warlitz | |
| 2006/0180522 | A1 | 8/2006 | Legtenberg | |
| 2007/0034554 | A1 | 2/2007 | Van Der Weijden | |
| 2013/0060509 | A1 | 3/2013 | Tsundoda | |
| 2013/0233776 | A1 | 9/2013 | Berkhout | |
| 2014/0238906 | A1 | 8/2014 | Mohanty | |
| 2014/0309782 | A1 | 10/2014 | Sharpe | |

FOREIGN PATENT DOCUMENTS

| | | | |
|---|---|---|---|
| DE | 2436864 | | 2/1976 |
| DE | 2928886 | | 1/1980 |
| DE | 4125236 | | 4/1992 |
| DE | 4223812 | | 8/1993 |
| DE | 4332743 | A1 | 4/1994 |
| DE | 9419448.3 | U1 | 2/1995 |
| DE | 19521415 | | 1/1997 |
| DE | 19649154 | | 3/1998 |
| DE | 19832828 | A1 | 1/2000 |
| DE | 19838170 | | 3/2000 |
| DE | 10056658 | | 7/2002 |
| DE | 102005054811 | | 1/2007 |
| EP | 0550867 | | 12/1992 |
| EP | 1676645 | A1 | 7/2006 |
| ES | 2274434 | | 12/2005 |
| ES | 2352027 | | 2/2011 |
| FR | 2668961 | | 5/1992 |
| GB | 4684 | | 0/1909 |
| JP | S52-165273 | | 12/1977 |
| JP | S59-19576 | A | 2/1984 |
| JP | H07256231 | | 10/1995 |
| JP | 2000-70754 | | 3/2000 |
| JP | 2002-59083 | | 2/2002 |
| JP | 2003-170122 | | 6/2003 |
| JP | 2006-63152 | | 3/2006 |
| JP | 2007-116611 | | 5/2007 |
| JP | 2010-76178 | | 4/2010 |
| JP | 11-221524 | | 4/2011 |
| KR | 10-0585342 | | 10/2004 |
| WO | WO 99/06151 | | 2/1999 |
| WO | WO 00/56472 | | 9/2000 |
| WO | WO 2004/082839 | | 9/2004 |
| WO | WO 2009/123452 | | 10/2009 |

OTHER PUBLICATIONS

International Search Report dated Jul. 3, 2009 from PCT/NL2009/050165.

Chinese Search Report dated Sep. 28, 2012, from CN 200980115792.4.

International Search Report dated Aug. 15, 2011 from PCT/NL2011/050515.

Office Action dated Jan. 13, 2015, from U.S. Appl. No. 13/812,222.

Notice of Allowance dated Jun. 30, 2015, from JP App. No. 2013-556566, with English Translation.

Notice of Preliminary Rejection from KR039889379 dated Jun. 15, 2015 in English.

OA May 25, 2015 from CN App 2012800159125 wEnglish Translation.

Notice of Allowance dated Sep. 25, 2015 from U.S. Appl. No. 14/001,833.

Office Action dated Sep. 21, 2015 from U.S. Appl. No. 14/696,230.

* cited by examiner

SEPARATION-APPARATUS

RELATED APPLICATIONS

This application is a 35 U.S.C. §371 national phase application of PCT/NL2009/050165 (WO 2009/123452), filed on Apr. 1, 2009, entitled "Separation-Apparatus", which application claims priority to Netherlands Application No. 2001431, filed Apr. 2, 2008, each of which are incorporated herein by reference in their entirety.

The invention relates to a separation-apparatus for separating from a particle-stream at least a first fraction with particles of a first group of dimensions, and a second fraction with particles of a second group of dimensions, comprising an infeed-device for the particle-stream, a rotatable drum having at its circumference plates, each plate having a radially extending hitting surface for the particles, at least a first receiving area proximal to the drum for receipt therein of particles of the first fraction, and at least a second receiving area distant from the drum for receipt therein of particles of the second fraction.

Such an apparatus is known from DE-U-94 19 448. The known apparatus is suitable for separation of alien parts such as paper, plastic or glass from compost.

The known apparatus can be designed very straight-forwardly in view of the circumstance that the parts that are to be separated from the compost can be distinguished very easily therefrom. If however, the particle stream consists of particles of rather small dimensions and the particles are of comparable composition, then the known separation-apparatus is not equipped to separate from the particle stream a first fraction and a second fraction, wherein the fractions differ from each other only modestly in terms of the parameters that characterize the particles of said fractions. This can be explained for instance with reference to bottom-ash of waste incineration plants, although the invention is not restricted thereto.

The November-December 2007 issue of Waste Management World, pages 46-49, elaborates on bottom ash from such waste incineration plants as being by far the largest residue fraction after the incineration process. Due to the conditions of incineration, various materials including metals are comprised in the bottom ash. However, temperatures during the waste incineration process are generally not as high that these materials result in aggregated particles of metals with slag. Instead some 80% of the metals in the ashes are free and suited for re-use. It is said that with a particular type incinerator approximately 50% of the course bottom ashes consist of particles being larger than 2 mm. Conversely, another 50% of the materials is smaller than 2 mm. Particularly, the separation of particles which can be classified as part of a first fraction having dimensions smaller than 2 mm from particles being classified in a fraction having dimensions larger than 2 mm is a good example of the problems that are encountered when their separation is envisaged in a separation apparatus according to the preamble. Since the problems and the objectives that are connected with the separation of said first and second fractions from a particle-stream originating from bottom ash are very illustrative for the invention, the following discussion primarily utilizes the example of processing of bottom ash. It is expressly noted however that the separation-apparatus is not exclusively useable for processing of bottom ash but can be applied to process any type of particles having small dimensions.

On average, in the composition of bottom-ash aggregates of stone, glass and ceramics account for approximally 80% percent of its content and 7 to 18 percent account for ferrous and non-ferrous metals, whereas the remainder generally consists of organic material.

The main non-ferrous metal is aluminium which is present through the entire particle size range of the ash. Other non-ferrous metals are copper, brass, zinc, lead, stainless steel and precious metals which account for large parts of the 2-6 mm fraction or higher up to 15 mm. Such metals that originate from electronic components are largely in the 0-2 mm fraction.

It is an object of the invention to provide a separation-apparatus which is particularly suitable for carrying out a separation-method on a particle stream having particles in the ranges just mentioned. It is a further objective to provide such a separation apparatus and method of its operation, which is applicable to particles that are moist. When the separation-apparatus is to be applied with respect to bottom ash an additional problem is that such bottom ash is relatively wet; it may comprise 15-20 weight % water.

A further objective is to provide a separation-apparatus which renders it possible to regain ferrous and non-ferrous metals of a particle stream with particles having dimensions in the range 0-15 mm.

Still a further objective is to provide such a separation-apparatus in which a first fraction and a second fraction of particles can be separated from a particle stream, wherein the first fraction has particles with a size in the range 0-2 mm and the second fraction has particles with dimensions in the range 2-15 mm.

These and other objectives and advantages that will become apparent from the following description, can at least in part be attained with a separation-apparatus and a method for its use in accordance with one or more of the appended claims.

A first feature of the separation-apparatus according to the invention is that the apparatus has a housing so as to protect the particles from outside weather-conditions, allowing that the particles of the particle-stream to be processed by said apparatus have dimensions in the range 0-15 mm. In contrast to the separation-apparatus that is known from DE-U-94 19 448 it is not possible to apply the separation-apparatus without a housing in view of the particles having such small dimensions that the processing thereof would not be feasible at windy conditions. The application of a housing as part of the apparatus is therefore essential so as to allow that the particles being processed in the separation-apparatus have dimensions in the range 0-15 mm.

A further aspect of the separation-apparatus of the invention is that the infeed-device is a vibrating plate having an edge positioned above the drum, which edge is embodied as an outlet for the particle-stream. The application of a vibrating plate is very suited to supply the particle stream in a controlled manner to the drum, in a way that the particle-stream will leave the vibrating plate in a continuous flow and with a limited thickness of the flow, so as to provide that the flow has properties similar to those of a monolayer flow of material. The concept of monolayer-flow is known to the person skilled in the art and does not require further elucidation.

The just-mentioned objective of approaching the parameters of a monolayer flow of material renders it advisable that the infeed-device operates in use at a vibrating-frequency of more than 10 Hz and with an amplitude of less than 5 mm.

A feature that further supports the just-mentioned objective is to embody the infeed-device as a vibrating plate with an edge and a sloping plate immediately adjacent to said edge that tilts downwards as seen from the edge. It suffices that the tilting downwards of the sloping plate adjacent to the edge of the vibrating plate is in the range of 70-90 degrees with reference to the horizon.

In a further aspect of the separation-apparatus of the invention the edge of the vibrating plate is positioned vertically or near-vertically above an axis of rotation of said drum so as to cause that in use the particles of the particle-stream fall towards the drum in a direction aimed towards said axis of rotation or its immediate vicinity, and to arrange that the plates of the drum impinge on said falling particles at a moment that said plates are in a vertically or near-vertically upwards oriented position extending from the drum. In this way the operation of the plates of the drum acting on the falling particles of the particle stream cause that the particles stepwise change direction from vertical flow to an essentially horizontal displacement, which is at the root of the separation of the particle stream into the first fraction and the second fraction. Surprisingly, it has been demonstrated that the first fraction pertaining to particles having smaller dimensions, preferably in the range 0-2 mm, do not travel as far from the drum as do the particles from the second fraction pertaining to particles having relatively larger dimensions, preferably in the range 2-15 mm. The separation-apparatus of the invention is thus very suited for use as a classifying means for the particles of the particle stream, and when the particle stream originates from waste-incineration ashes the separation-apparatus can beneficially be used to classify metals from said ashes into the first fraction and the second fraction, each fraction having the particles with the just-mentioned dimensions. It is then preferred that the second fraction be further processed in a dry separation method to separate the metals from this fraction further into ferrous and non-ferrous metals. This is due to the circumstance that during processing of the particle stream in the separation-apparatus of the invention it has been shown that the second fraction has already lost much of its water content.

It has further proven beneficial that the plates are provided with a backing that slopes from the free extremities of said plates towards the drum's circumference so as to counter turbulence behind said plates.

The effective operation of the separation-apparatus of the invention is secured by having the drum during its operation rotating at a speed causing that the plates of the drum impinge on the particles with a horizontal speed in the range 10-30 m/s.

It is further beneficial to provide the separation-apparatus of the invention with means for providing a gas flow having a flow direction that is pointed from the second receiving area for the particles to the drum. This has at least the following three effects:

1. A better separation between the first fraction and the second fraction can be obtained as compared to the situation in which the gas flow is absent.

2. The separation-apparatus can be construed with smaller dimensions.

3. It is possible to limit the air humidity, thus promoting that the larger particles can lose their moist content more easily.

A further desirable feature of the separation-apparatus according to the invention is that the said at least second receiving area distant from the drum is provided with a conveyor for discharging the particles of the second fraction received in said second area, at which conveyor's outlet a blower is provided supplying a downwardly directed air-flow for removal of particles of the first fraction that stick to particles of the second fraction.

The invention will hereinafter be further elucidated with reference to an exemplary schematic embodiment of the separation-apparatus of the invention and with reference to the drawing.

In the drawing.

Wherever in the figures the same reference numerals are applied these numerals refer to the same parts.

Figure 1:
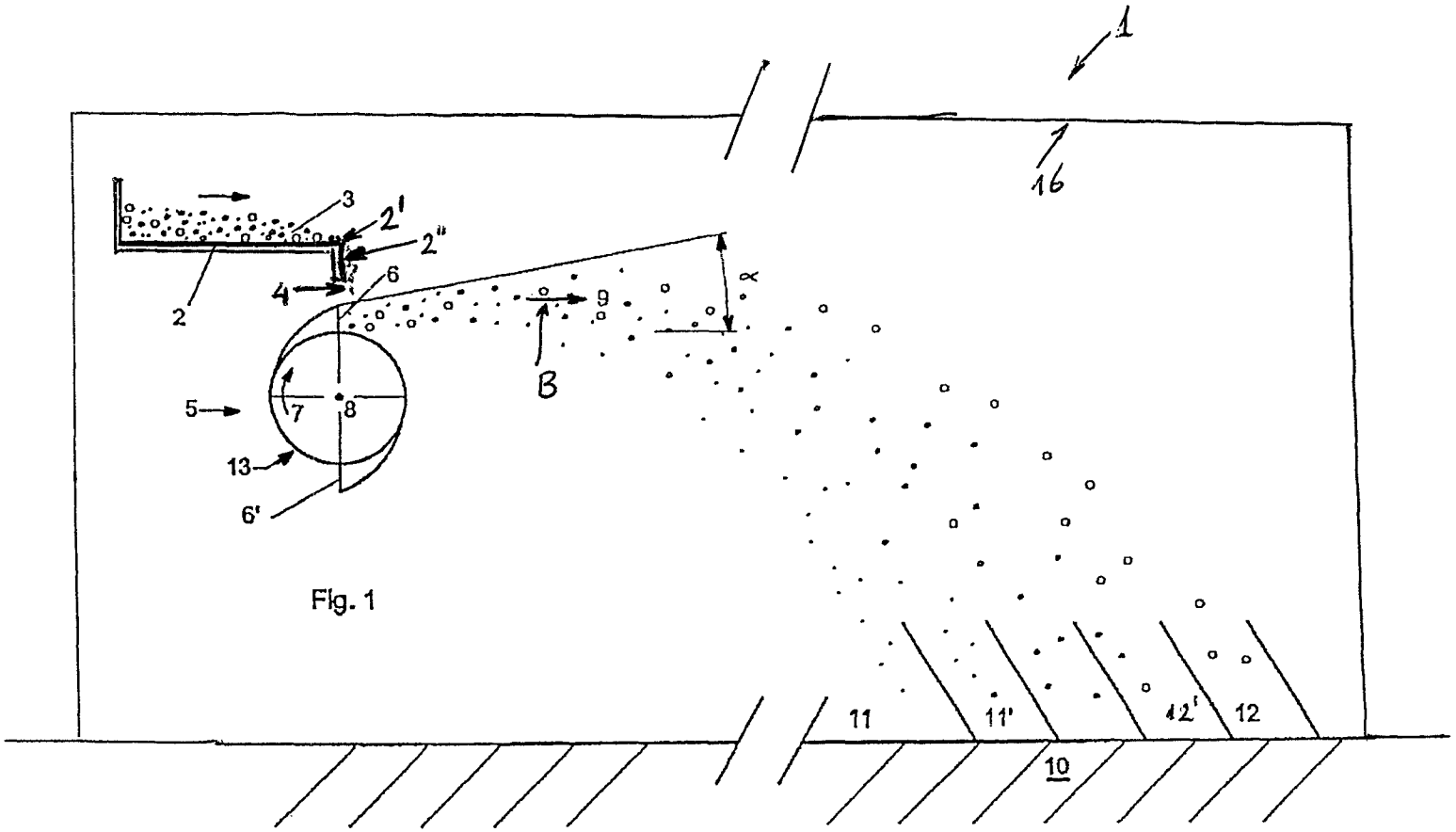
FIG. 1 shows schematically the separation-apparatus of the invention.

With reference first to FIG. 1 the separation-apparatus of the invention is generally denoted with reference numeral 1. This separation-apparatus 1 is used for separating particles 3 of a first fraction and of a second fraction wherein the respective fractions pertain to particles having different dimensions.

The particles 3 are collectively supported by an infeed-device 2. The infeed-device 2 is a plate which is arranged to be vibrated causing then that the particles 3 leave the vibrating plate over the edge 2' in a particle stream as symbolised by the arrow 4. The particle stream 4 is over the edge 2' further supported by a downwardly sloping slide-plate 2" that supports the development of a monolayer-type flow of said particle stream 4.

The edge 2' of the vibrating plate 2 is positioned above a drum 5, which can rotate around its axis 8 of rotation and which drum 5 has at its circumference 13, plates 6, 6'. Each plate 6, 6' has a radially extending hitting surface 6, 6' for impinging on the particles 3 that arrive in the vicinity of the drum 5.

In order to secure that a proper particle stream 4 resembling a monolayer stream arrives near the drum 5, it is further preferable that the vibrating plate 2 vibrates at a frequency of more than 10 Hertz, preferably 20 Hz and an amplitude of less than 5 mm, preferably one or two mm. As already mentioned it is preferred to apply a slide-plate 2" that slightly tilts downwards as seen from the edge 2'. This tilting downwards can be in the range of 70-90 degrees as compared to the horizon.

As FIG. 1 clearly shows the edge 2' of the vibrating plate 2 is positioned vertically or near vertically above the axis 8 of rotation of the drum 5 so as to cause that in use the particles 3 of the particle stream 4 fall towards the drum 5 in a direction aimed towards said axis 8 of rotation or to its immediate vicinity. This construction further arranges that the plates 6, 6' of the drum 5 impinge on said falling particles 3 at a moment that said plates 6, 6' are in a vertically or near vertically upwards oriented position extending from the drum 5. This is shown in FIG. 1 with respect to plate 6.

Figure 2:
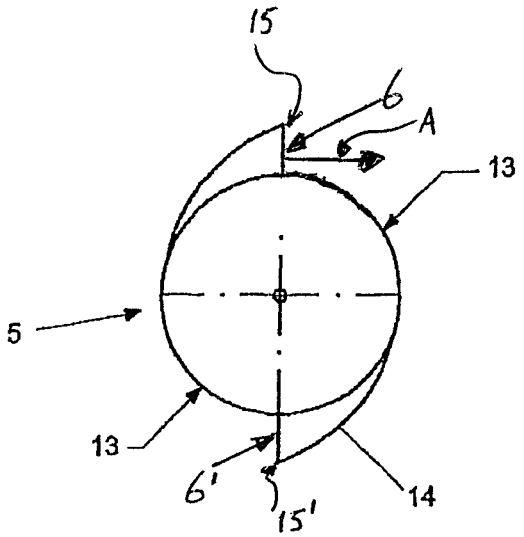
FIG. 2 and FIG. 3 show the drum of the separation-apparatus of the invention in a side and a frontal view, respectively.
Figure 3:
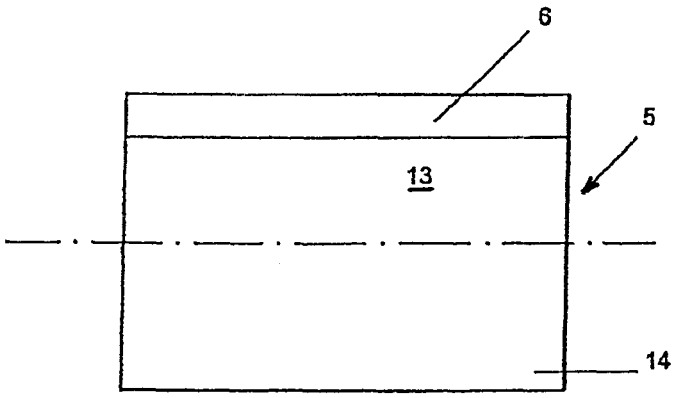

As shown more clearly in FIG. 2, the plates 6, 6' are provided with a backing 14 that slopes from the free extremities 15, 15' of said plates 6, 6' towards the drum's circumference 13. This way turbulence behind the plates 6, 6' is effectively avoided during rotation of the drum 5.

In use the drum 5 is caused to rotate at a speed such that the plates 6, 6' impinge on the particles 3 in the particle stream 4 with a horizontal speed (see arrow A in FIG. 2) in the range 10-30 m/s. Due to this action FIG. 1 shows that a cloud of particles moves in the direction of arrow B to be collected in at least a first receiving area 11, 11' proximal to the drum 5 for receipt therein of the smaller particles of the first fraction, and at least a second receiving area 12, 12' for receipt therein of the larger particles of the second fraction.

With a proper tuning of the vibrating plate 2 in terms of vibrating frequency and vibrating amplitude and by a proper selection of the rotational speed of the drum 5 it is possible to realise an effective separation of the particles into a first and into a second fraction, wherein the first fraction pertains to particles having dimensions in the range 0-2 mm and the second fraction pertains to particles having dimensions in the range 2-15 mm. A proper operation of the apparatus of the invention can be identified when the particles leave the drum 5 in a manner that their angle of departure α does not surpass 12 degrees as compared to the horizon (see FIG. 1).

FIG. 1 further shows that the separation apparatus 1 is embodied with a housing 16 in order to protect the particles 3 from outside weather conditions, thus allowing that the particles 3 of the particle stream 4 having dimensions in the range 0-15 mm can at all be processed in the apparatus of the invention.

Although not shown in FIG. 1 the apparatus 1 of the invention may in a preferred embodiment further be provided with means for providing a gas flow having a flow direction opposite to the arrow B, thus pointing from the second receiving area 12, 12' towards the drum 5.

Figure 4:
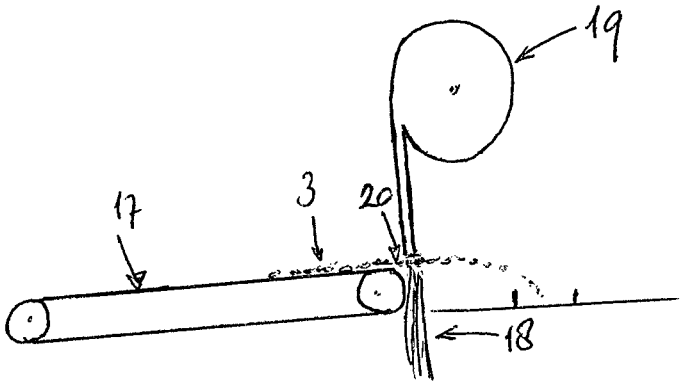
FIG. 4 shows a conveyor for discharging particles being processed in the separation-apparatus of the invention.

Any of the first receiving areas 11, 11' and the second receiving areas 12, 12' is in practice provided with conveyor belts for removing the collected particles from said areas. An example of a conveyor belt that is applied with anyone of the second receiving areas 12, 12' is shown in FIG. 4 and provided with reference numeral 17. Particles 3 are discharged from any such second area 12, 12' and transported by the conveyor 17 operating at a conveying speed that is high enough to cause that the particles 3 leave the conveyor belt 17 with a speed sufficient for the particles to travel through an essentially transversal air-flow 18. Due to the air-flow 18 particles of a first smaller fraction that attach or stick to larger particles 3 of the second fraction are released. The air-flow 18 can easily be arranged by application of a blower 19 providing preferably a downwardly directed air stream 18 immediately adjacent to the exit point or outlet 20 where the particles 3 leave the conveyor belt 17.

The inventors expressly point out that the exemplary embodiment as discussed hereinabove relates to the operation and construction of the separation-apparatus of the invention without necessarily being restricted to the processing of waste-incineration ashes or bottom ashes. The separation apparatus of the invention is generally applicable to any type of particle that is required to be classified into fractions of particles having dimensions in the lower ranges such as 0-15 mm without being restricted to such particles as are derived from waste incineration plants.

The invention claimed is:

1. A separation-apparatus for separating from a particle-stream at least a first fraction with particles of a first group of dimensions, and a second fraction with particles of a second group of dimensions, comprising:

an infeed-device for the particle-stream, wherein the particle-stream is a moist stream of particles sized in the range of 0-15 mm, a rotatable drum having at its circumference plates, each plate having a radially extending hitting surface for the particles, at least a first receiving area proximal to the drum for receipt therein of particles of the first fraction, and at least a second receiving area distant from the drum for receipt therein of particles of the second fraction, wherein the infeed-device comprises a vibrating plate having an edge positioned above the drum, which edge is embodied as an outlet for the particle-stream, the infeed-device further comprising a slide-plate immediately adjacent to said edge that tilts downwards as seen from the edge, the slide-plate being inclined at an angle in the range 70-90 deg. with respect to the horizon, the vibrating plate and the slide plate cooperating to cause in use a mono-layer type flow of the particle stream comprising a plurality of particles across a width of the particle stream, and the edge of the vibrating plate being positioned vertically or near-vertically above an axis of rotation of said drum so as to cause that in use the particles of the particle-stream fall towards the drum in a direction aimed towards said axis of rotation or its immediate vicinity, and such that the plates of the drum impinge on said falling particles at a moment that said plates are in a vertically or near- vertically upwards oriented position extending from the drum.

2. The separation-apparatus according to claim 1, further comprising the rotatable drum being configured so that in use the drum rotates at a speed causing that the plates impinge on the particles with a horizontal speed in the range 20-30 m/s.

3. The separation-apparatus according to claim 1, further comprising the infeed-device being configured to operate in use at a vibrating-frequency of more than 10 Hz and an amplitude of less than 5 mm.

4. The separation-apparatus according to claim 1, further comprising the apparatus having a housing configured to protect the particles from outside weather-conditions.

5. The separation-apparatus according to claim 1, further comprising the plates comprising a backing that slopes from the free extremities of said plates towards the drum's circumference so as to counter turbulence behind said plates.

6. The separation-apparatus according to claim 1, further comprising means for providing a gas flow having a flow-direction that is pointed from the second receiving area towards the drum.

7. The separation-apparatus according to claim 1, further comprising said at least second receiving area distant from the drum comprising a conveyor for discharging the particles of the second fraction received in said second area, at which conveyor's outlet a blower is provided supplying a downwardly directed airflow for removal of particles of the first fraction that stick to particles of the second fraction.

8. A method of separating a moist stream of particles sized in the range 0-15 mm in a separation-apparatus according to claim 1.

9. The method according to claim 8, wherein the particles are separated into at least a first fraction with particles having dimensions in the range of 0-2 mm, and a second fraction with particles having dimensions in the range of 2-15 mm.

10. The method according to claim 9, further comprising the particle stream originating from waste-incineration ashes, and wherein the separation-apparatus is used to classify metals from said ashes into the said first fraction and said second fraction.

11. The method according to claim 10, further comprising processing said second fraction in a dry-separation method to separate the metals into ferrous and non-ferrous metals.

12. The method according to claim 8, further comprising the stream of particles having a moisture-content of 15-20 percent by weight.

13. The method according to claim 8, further comprising prior to subjecting the particle stream by the processing in said separation-apparatus, the particle stream is sieved so as to restrict the particles to sizes in the range 0-15 mm.

14. The separation-apparatus according to claim 1, wherein the angle of departure, α, of the particles at the plates in operation is less than 12 degrees relative to the horizon.

* * * * *